US008931194B2

(12) United States Patent
Laney et al.

(10) Patent No.: US 8,931,194 B2
(45) Date of Patent: Jan. 13, 2015

(54) MUZZLE-LOADING FIREARM WITH A REMOVABLE, THREADLESS BREECH PLUG

(71) Applicant: LHR Sporting Arms, LLC, Rochester, NH (US)

(72) Inventors: Mark C. Laney, Lee, NH (US); Karl K. Ricker, Rochester, NH (US)

(73) Assignee: LHR Sporting Arms, LLC, Rochester, NH (US)

( * ) Notice: Subject to any disclaimer, the term of this patent is extended or adjusted under 35 U.S.C. 154(b) by 0 days.

(21) Appl. No.: 13/952,871

(22) Filed: Jul. 29, 2013

(65) Prior Publication Data

US 2014/0033588 A1 Feb. 6, 2014

Related U.S. Application Data

(60) Provisional application No. 61/677,720, filed on Jul. 31, 2012.

(51) Int. Cl.
*F41C 7/00* (2006.01)
*F41C 9/08* (2006.01)

(52) U.S. Cl.
CPC ..... *F41C 9/08* (2013.01)
USPC ..... 42/51; 89/1.3

(58) Field of Classification Search
CPC ..... F41C 9/08
USPC ..... 42/51; 89/1.3
See application file for complete search history.

(56) References Cited

U.S. PATENT DOCUMENTS

| | | | | |
|---|---|---|---|---|
| 4,004,364 | A | 1/1977 | Chatigny | |
| 4,437,249 | A * | 3/1984 | Brown et al. | 42/51 |
| 5,133,143 | A | 7/1992 | Knight | |
| 6,219,951 | B1 | 4/2001 | Cate | |
| 6,532,692 | B2 | 3/2003 | Cate | |
| 7,774,971 | B2 | 8/2010 | Laney et al. | |
| 7,814,694 | B2 | 10/2010 | Laney et al. | |
| 7,954,269 | B2 | 6/2011 | Laney et al. | |
| 8,096,075 | B2 | 1/2012 | Laney et al. | |
| 2006/0248771 | A1 * | 11/2006 | Richards | 42/51 |
| 2007/0039222 | A1 * | 2/2007 | Lizarralde et al. | 42/51 |
| 2007/0181029 | A1 * | 8/2007 | Mcaninch | 102/430 |
| 2008/0092420 | A1 * | 4/2008 | Simms | 42/51 |
| 2008/0282596 | A1 * | 11/2008 | DeLeeuw | 42/51 |

* cited by examiner

*Primary Examiner* — Gabriel Klein
(74) *Attorney, Agent, or Firm* — Devine, Millimet & Branch; Paul C. Remus; Kimberly A. Peaslee

(57) ABSTRACT

An improved muzzle-loading firearm with a removable, threadless breech plug retained by a breech plug retaining collar, and a barrel retaining nut for simplifying manufacture, cleaning, preventing fouling and over-pressure situations, and minimizing alignment issues during, assembly of the firearm. The removable, threadless breech plug also allows for straightforward interchangeability of breech plugs for use with various primers and propellants.

5 Claims, 8 Drawing Sheets

MUZZLE-LOADING FIREARM WITH A REMOVABLE, THREADLESS BREECH PLUG

CROSS-REFERENCE TO RELATED APPLICATIONS

The present application claims the benefit of Provisional Patent Application Ser. No. 61/677,720 filed Jul. 31, 2012, which is incorporated herein by reference.

FIELD OF THE INVENTION

The present in relates to a muzzle-loading firearm with a removable breech plug. More particularly, it relates to a muzzle-loading firearm with a removable, threadless breech plug that extends into the bore of the firearm and is retained by an internally-threaded breech plug retaining collar.

BACKGROUND OF THE INVENTION

A muzzle-loading firearm is a firearm in which the projectile and propelling charge is loaded through the muzzle (i.e. the front-end of the barrel), in contrast to a breech-loading firearm in which the projectile and propelling charge is loaded through the breech, or rear end, of the barrel.

Muzzle-loading firearms typically have a barrel with an attached breech plug. In some muzzle-loading firearms the breech plug is permanently attached, and in others it is removable. Removable breech plugs facilitate pass-through cleaning of the bore of the barrel. Removable breech plugs also facilitate unloading, and clearing a miss-fire in the firearm.

Many prior ant removable breech plugs are externally-threaded, and as such, they thread into the barrel of the firearm. In these systems, the barrel is internally-threaded to accept the threaded breech plug. Internally-threaded barrels create several problems including a potential for fouling of the threads during cleaning of the bore. This can make the breech plug difficult or impossible to reinstall or remove. Externally-threaded breech plugs are also generally larger in diameter than the bore of the barrel so that there is a tight seal when the breech plug is installed. The thickness of the barrel wall surrounding the plug is often thinner than the barrel wall just in front of the plug, which can create a strength limitation in the barrel and a risk of expansion. If a thicker barrel wall is then required, it can increase manufacturing cost and/or the weight to the firearm.

In externally-threaded breech plug systems, the barrel must he designed to retain the externally-threaded breech plug even in overpressure circumstances. The barrel must have adequate thickness to resist excessive expansion in such extreme circumstances to ensure that the barrel's internal threads do not fail to retain the plug. Further, the length of the externally-threaded breech plug must be long enough to provide adequate strength to retain the pressure necessary in the chamber. Thus, the length of the externally-threaded breech plug extends the length of the barrel of the firearm without extending the length from the breech face to the muzzle. The added barrel length increases the weight and cost of the firearm without the performance advantages of a lengthened barrel.

In other firearms with removable breech plugs, such as in the Harrington & Richardson 45, the breech plugs are push in breech plugs. The push in breech plug are sealed with a neoprene O-ring, or a nylon ring. These push in breech plugs are removable by opening the breech and pushing out the plug with a ram rod. The push-in breech plugs are held in by friction. The push in breech plugs are considered unsafe as the breech plug is only secured when the breech is closed. If one opens the breech too quickly after a misfire, and the misfire is a hang fire, the expulsion of the pressurized gases would make serious injury likely.

In other prior art muzzle-loading firearms, there is no breech plug. Instead, an internally-threaded breech cap is threaded onto the externally-threaded barrel of the firearm, and the base of the breech cap overlays the face of the rear end of the barrel. In the area of the base of the breech cap which overlays the end of the barrel, there is a central axial cylindrical primer pocket. The floor of the primer pocket has a central fire hole that communicates with a cylindrical chamber at the rear end of the barrel. The surfaces are tightly abutted to provide a gas seal against escape of propellant gases from the chamber upon discharge.

While systems without breech plugs overcame some of the problems caused by an externally-threaded breech plug, other problems still remain. For example, there are issues in using only a breech cap to retain the gas pressure in the chamber. The area of the barrel walls where they are threaded are necessarily thinner and are subject to expansion which can make removal and reinstallation of the breech cap difficult, if not impossible.

The present invention prevents over-pressure and expansion issues by locating the muzzle end of the breech plug forward of the threaded portion of the barrel where the walls of the barrel are not thinner. The present invention also minimizes the problems associated with hack-pressure by providing a removable, threadless breech plug, and a breech plug, retaining collar. These features allow not only for ease of manufacture and cleaning but also for preventing fouling and overpressure. The present invention solves additional problems of prior art muzzle-loading firearms by providing a barrel retaining nut. This feature allows for ease of manufacture, finishing and cleaning and prevents fouling. The removable, threadless breech plug further allows for the interchangeability of breech plugs to accommodate a variety of different primers and propellants thus improving the usability and accuracy of the firearm.

SUMMARY OF THE INVENTION

It has been recognized that there is a need for a muzzle-loading firearm with an improved removable breech plug.

In one embodiment of the present invention, a muzzle-loading firearm comprises a barrel, wherein the barrel has a bore, a breech end, and a muzzle end, and wherein the barrel is externally threaded at the breech end; a mono block, wherein the mono block has a breech end and a muzzle end, and is adapted to accept the breech end of the barrel when the breech end of the barrel is inserted into the mono block; a barrel retaining nut, wherein the barrel retaining nut is internally threaded to accept the externally threaded end of the barrel thereby retaining the barrel in the mono block; an internally-threaded breech plug retaining collar, wherein the internally-threaded breech plug retaining collar has a breech face and a muzzle face and is threaded onto the breech end of the barrel so that the muzzle face of the breech plug retaining collar abuts the barrel retaining nut when installed on the firearm; and a removable, threadless breech plug, wherein the breech plug has a breech end, a primer pocket recessed in the breech end, and a muzzle end and the muzzle end is configured to fit inside the breech end of the barrel, the breech end of the breech plug is set into the breech thee of the internally-threaded breech plug retaining collar, and the muzzle end of the breech plug extends past the muzzle face of the breech plug retaining collar thereby retaining the breech plug inside the bore of the barrel of the firearm when assembled.

In one embodiment of the present invention, the muzzle-loading firearm has a barrel with a protrusion on the breech end of the barrel that fits into a matched groove within the mono block for use in aligning the barrel during assembly of the firearm.

In one embodiment of the present invention, the muzzle-loading firearm has an interlock lever with a first end, a second end and a protrusion and is rotatably attached to the mono block and biased by a spring such that the protrusion will strike a button on the receiver and prevent the breech from closing unless the breech plug retaining collar is threaded onto the breech end of the barrel thereby impinging on the first end of the interlock lever and rotating it so that the protrusion does not strike the button on the receiver and prevent the breech from closing.

In one embodiment of the present invention, the muzzle-loading firearm has a removable, threadless breech plug wherein the muzzle end is concave.

In one embodiment of the present invention, the muzzle-loading firearm has a removable, threadless breech plug wherein the muzzle end is adapted, to accommodate a pre-formed, pelletized propellant.

In one embodiment of the present invention, the muzzle-loading firearm has a removable, threadless breech plug wherein the muzzle end is adapted to accommodate powder propellant.

In one embodiment of the present invention, the muzzle-loading firearm has a removable, threadless breech plug with a primer pocket that is adapted to accept 209 primers.

These aspects a the invention are not meant to be exclusive, and other features, aspects, and advantages of the present invention will he readily apparent to those of ordinary skill in the art when read in conjunction with the following description, appended claims, and accompanying drawings.

BRIEF DESCRIPTION OF THE DRAWINGS

The foregoing and other objects, features, and advantages of the invention will be apparent from the following description of particular embodiments of the invention, as illustrated in the accompanying drawings in which like reference characters refer to the same parts throughout the different views. The drawings are not necessarily to scale, emphasis instead being, placed upon illustrating the principles of the invention.

DETAILED DESCRIPTION OF THE INVENTION

The present in provides a muzzle-loading firearm with a removable, threadless breech plug retained by a breech plug retaining collar. These features not only allow for ease of manufacture and cleaning but also prevent fouling and over-pressure situations. The removable, threadless breech plug allows for interchangeability of breech plugs for use with various primers and propellants, which improves the usability and accuracy of the firearm. The breech plug retaining collar is part of an interlock mechanism. The present invention also provides a barrel retaining nut. This feature allows for ease of manufacture, finishing, and cleaning and prevents fouling.

Figure 1:
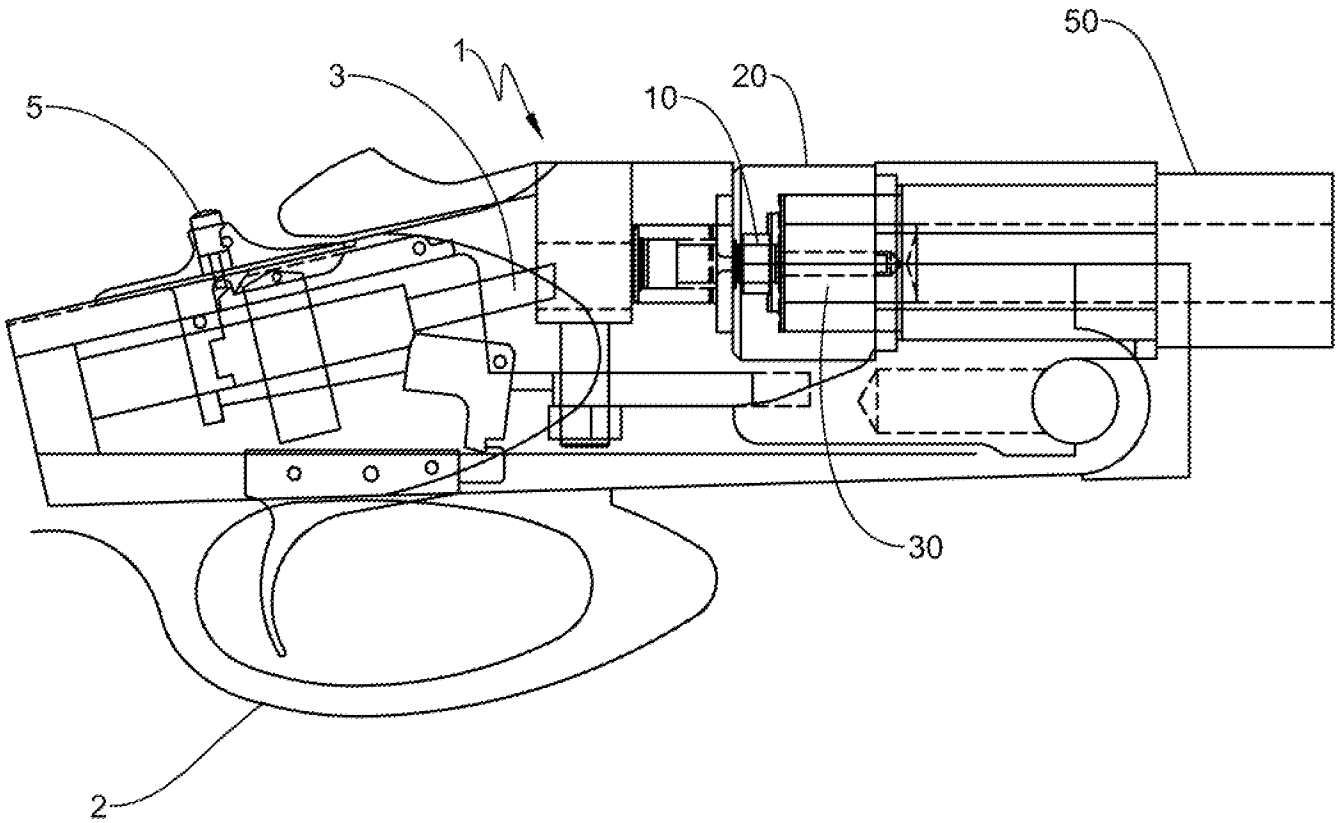
FIG. 1 is a sectional side view of a muzzle-loading firearm according to one embodiment of the present invention.

FIG. 1 shows a sectional side view of a muzzle-loading firearm according to one embodiment of the present invention. More particularly, the muzzle-loading firearm has a receiver 1, a trigger assembly 2, a firing pin 3, and a safety assembly 5. The barrel of the firearm of the present invention 50 is externally-threaded at the breech end to accept an internally-threaded breech plug retaining collar 20.

Figure 4:
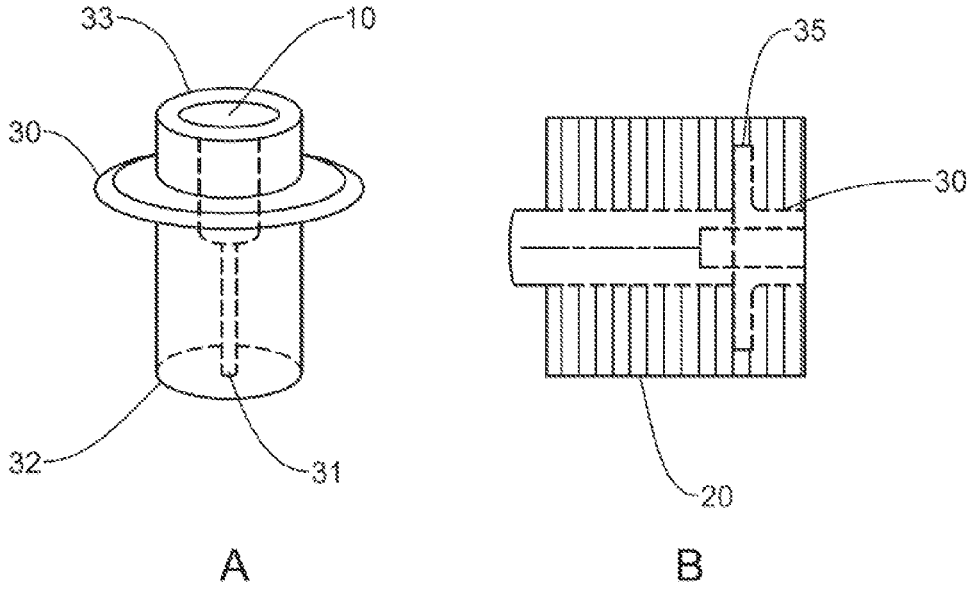
FIG. 4A is a side view of one embodiment of a removable, threadless breech plug of the present invention.
FIG. 4B is a side view of removable, threadless breech plug inside a breech plug retaining collar of one embodiment of the present invention.

Still referring to FIG. 1, at the breech end of the barrel, there is a threadless, removable breech plug 30. The breech plug 30 has a breech end 33 and as muzzle end 32, which are best seen in FIG. 4A. The muzzle end 12 of the breech plug 30 extends into the bore of the barrel of the firearm to avoid expansion issues. The breech end 33 of the breech plug 30 is capable of receiving a primer in a primer pocket 10 and is flush with the breech plug retaining collar when installed.

The removability of the breech plugs of the present invention provides a mechanism for the user to swap out breech plugs to use with various primers and propellants quickly, easily and at a minimal cost. The breech end 33 of the threadless, removable breech plug 30 can be varied to accommodate different primers, and the muzzle end of the breech plug can be varied to accommodate different propellants (e.g. pre-formed pellets, powder, and the like).

Figure 2:
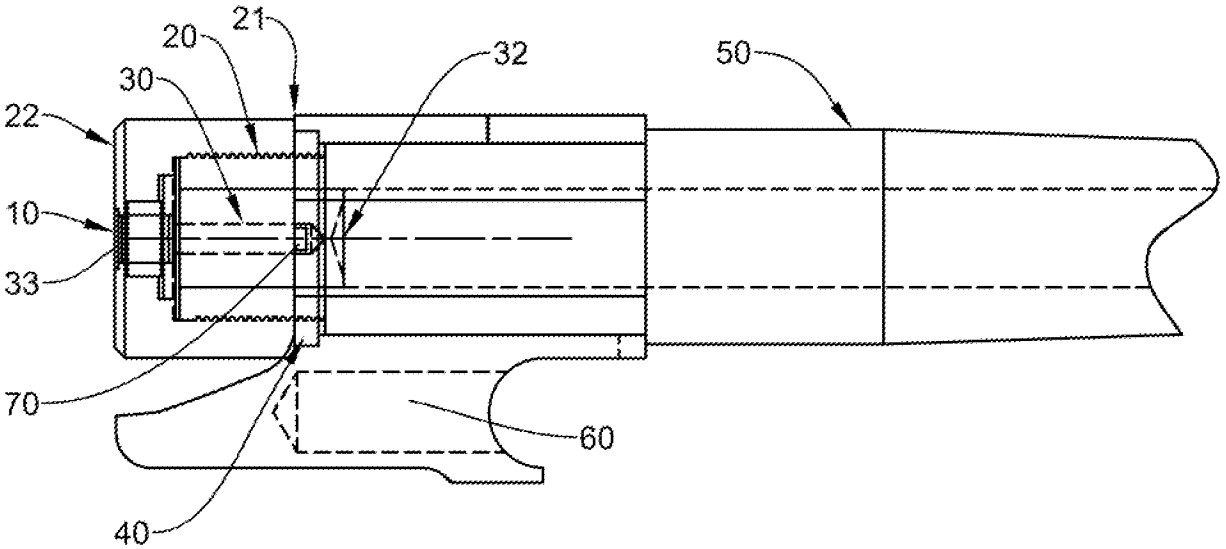
FIG. 2 is a side view of a barrel of a muzzle-loading firearm according to one embodiment of the present invention.

FIG. 2 shows a side view of a barrel of a muzzle-loading firearm according to one embodiment of the present invention. More particularly, the barrel 50 of the firearm of the present invention is externally-threaded at the breech end to accept an internally-threaded breech plug retaining collar 20 with a muzzle face 21 and a breech face 22. At the breech end of the barrel, there is a threadless, removable breech plug 30. The muzzle end 32 of the breech plug 30 extends into the bore of the barrel of the firearm. When the breech plug retaining collar 20 is threaded onto the barrel 50 with the breech plug 30 installed, the muzzle end 32 of the breech plug 30 extends into the bore of the barrel past the muzzle face 21 of the breech plug retaining collar 20 which allows the peak pressures to be moved forward in the barrel of the firearm to prevent swelling of the threaded section of barrel. The breech end 33 of the breech plug 30 is capable of receiving a primer, in a primer pocket 10, a cavity recessed into the breech end 33 of the breech plug 30, and thus the breech face 22 of the breech plug retaining collar 20.

In another embodiment of the present invention, as shown in in FIGS. 1 and 2, the externally threaded barrel 50 of the firearm is inserted through the mono block 60 and is held in place on the firearm by an internally threaded barrel retaining nut 40. The barrel retaining nut 40 fits into a recess in the mono block 60 when assembled. The barrel retaining nut can be tightened using a special tool (not shown). The barrel 50, barrel retaining nut 40, and mono block 60 assembly of the present invention also provides for ease of alignment during assembly and facilitates finishing and cleaning.

Figure 5:
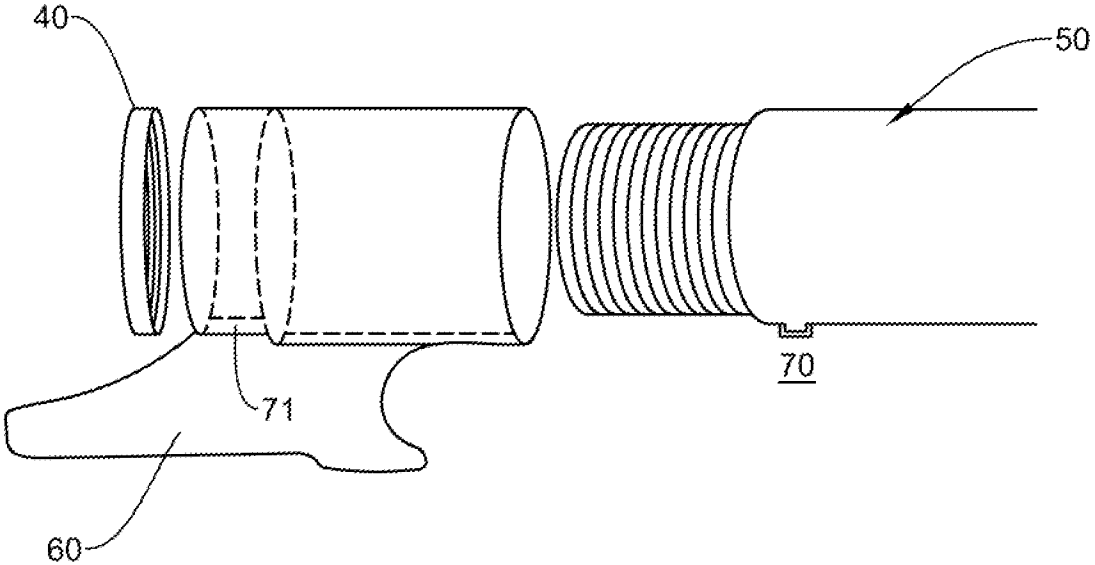
FIG. 5 is an exploded view of one embodiment of the muzzle-loading firearm of the present invention.

FIG. 5 is an exploded view of one embodiment of the muzzle-loading firearm of the present invention. More particularly, FIG. 5 shows that the barrel 50 contains a protrusion, or pin, 70 on the unthreaded portion of the breech end of the barrel 50, which fits into a matched groove 71 within the mono block 60. The protrusion, or pin, and groove allow for ease of alignment during assembly of the firearm. Also shown in FIG. 5 is the barrel retaining nut 40, which is recessed into the mono block 60 when assembled.

In prior art systems, barrels have been attached by pins, welds, or other mechanical means, but these methods required considerable additional effort at the assembly and/or finishing stages. The alignment of accessories, sight holds, scopes, and the like all needed to be addressed, or if they were attached earlier in the process, they would create an encumbrance to finishing by trapping solutions, oils, and the like, or by acting as obstacles when buffing, sanding, and the like. For example, "bluing" is a controlled oxidation of the surface of the firearm, and the residue left behind after this process needs to be flushed away or it can build up in the threads of the barrel or in other recesses and cause fouling issues, or add considerable effort to cleaning and assembling the firearm. The barrel 50, barrel retaining nut 40, and mono block 60 assemblies of the present invention overcome these flaws and allow manufacture, finishing, and cleaning components individually, which can then be assembled quickly and easily at a later time without time-consuming alignment steps.

Figure 3:
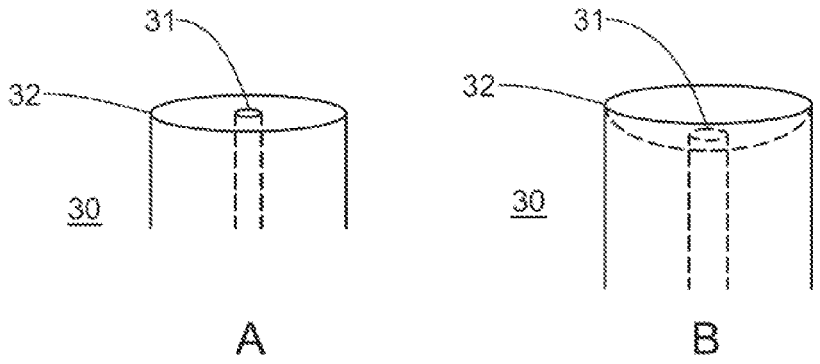
FIG. 3A is a side view of one embodiment of a removable, threadless breech plug of the present invention.
FIG. 3B is a side view of one embodiment of a removable, threadless breech plug of the present invention.

FIG. 3A is a side view of one embodiment of a removable, threadless breech plug 30 of the present invention. FIG. 3B is a side view of another embodiment of a removable, threadless breech plug 30 of the present invention. More particularly, the muzzle end 32 of the removable, threadless breech plugs 30 of the present invention have varying degrees of concavity depending on the type of propellant to be used. In FIG. 3A, the degree of concavity is less, which is well suited for use with pre-formed, pelletized propellants as the pre-formed pellets of propellant require a breech plug with a muzzle end shaped such that more surface area is in contact with the surface of the pre-formed propellant. In FIG. 3B, the degree of concavity is greater to accommodate better the use of classic black powder. The removability of the breech plugs of the present invention provides a mechanism for the user to swap out breech plugs to use various primers and propellants quickly, easily, and at a minimal cost.

FIG. 4A is a side view of one embodiment of a removable, threadless breech plug 30 of the present invention. FIG. 4B is a side view of a removable, threadless breech plug 30 in a breech plug retaining collar 20 of one embodiment of the present invention. More particularly, in FIG. 4A the threadless, removable breech plug 30, has a fire hole 31 that extends from the primer pocket 10 to the concave, muzzle end 32 of the breech plug 30. In FIG. 4B, the breech plug 30 is shown inside the breech plug retaining collar 20 to demonstrate that in one embodiment of the present invention the muzzle end 32 of the breech plug 30 extends beyond the muzzle face of the breech plug retaining collar 20. The muzzle thee of the breech plug retaining collar abuts the barrel retaining nut when installed on the firearm, and the muzzle end 32 of the breech plug extends into the barrel of the firearm. The area marked 35 represents where the end of the barrel would be, if shown. Thus, the breech plug extends into the bore, but is not threaded and does not create fouling issues or difficulty with removal or reinsertion.

Figure 6:
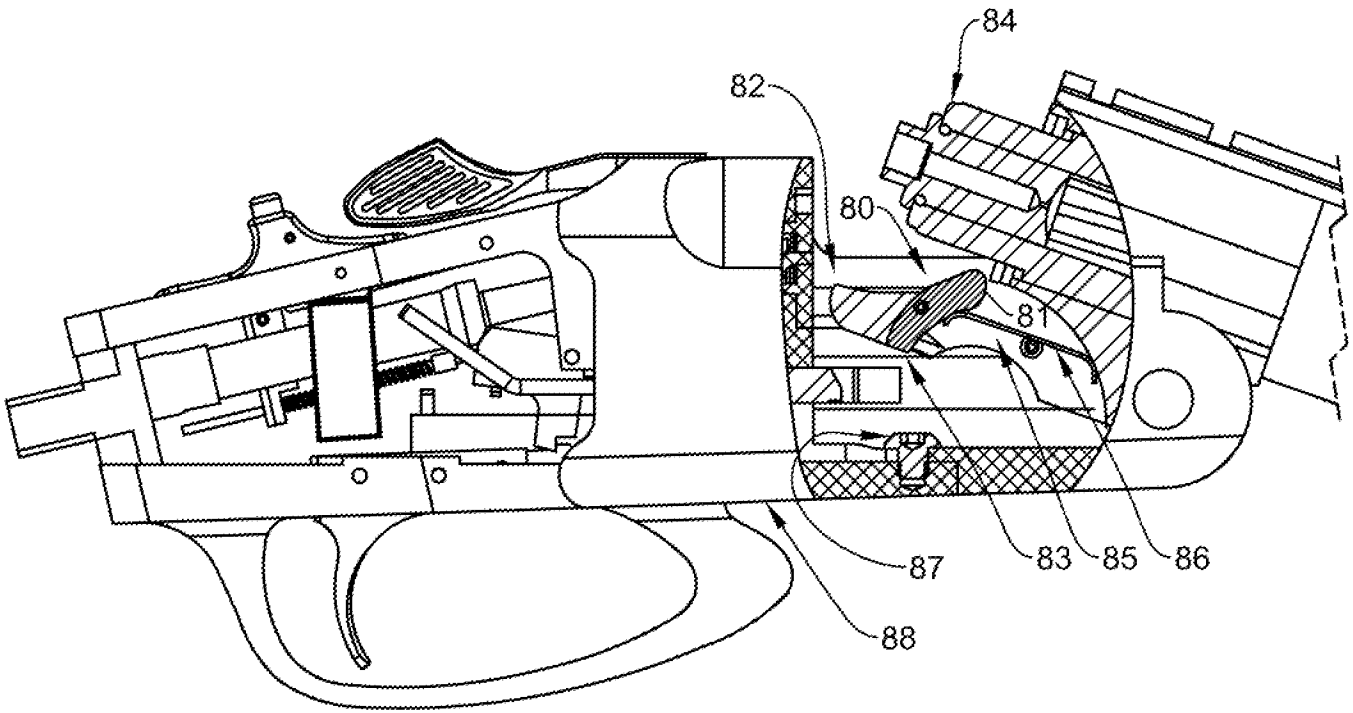
FIG. 6 is a side view of the open breech of a muzzle-loading firearm according to one embodiment of the present invention.
Figure 7:
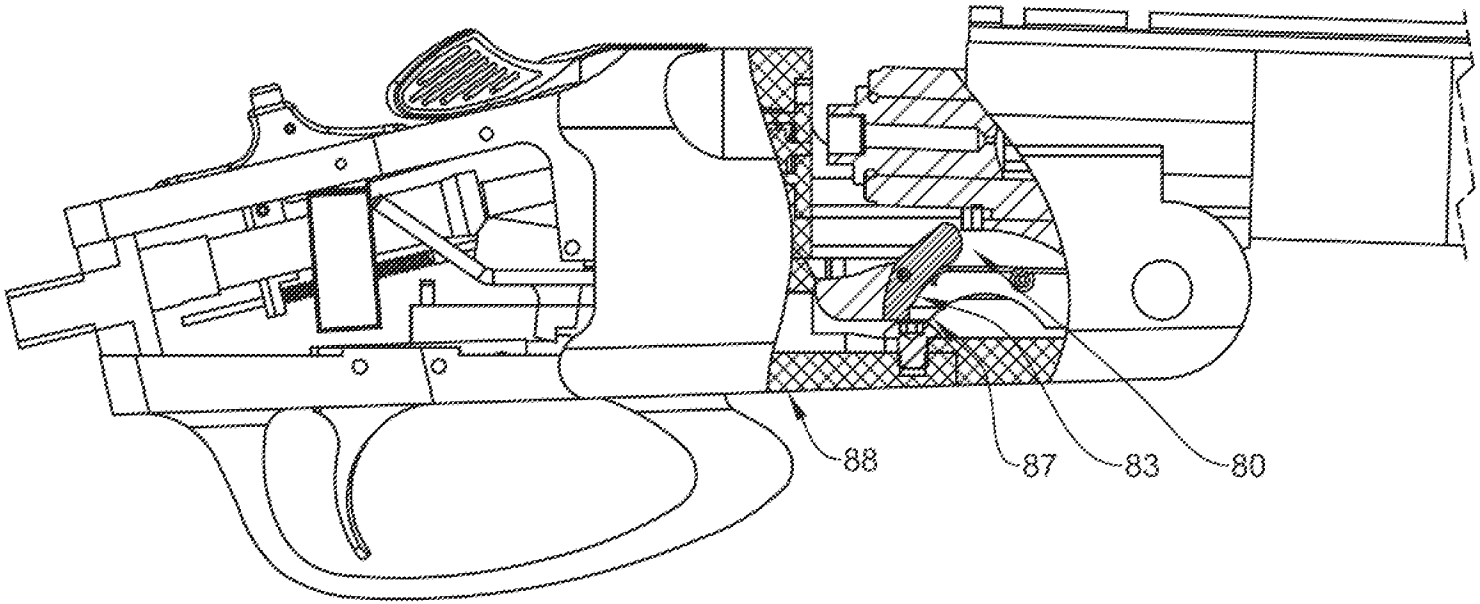
FIG. 7 is a side view of the closed breech of the muzzle-loading firearm shown in FIG. 6.

In another embodiment, as shown FIG. 6, an interlock lever 80, with a first end 81, a second end 82 and a protrusion 83 is rotatably attached to the mono block 85. When the breech is open and the breech plug retaining collar (not shown) is not attached to the barrel 84, a spring 86 biases the interlock lever 80 into a first position. When the safety lever 80 is in the first position, an attempt to close the breech, as shown in FIG. 7, will be unsuccessful because the protrusion 83 on the interlock lever 80 will strike a button 87 on the receiver 88.

Figure 8:
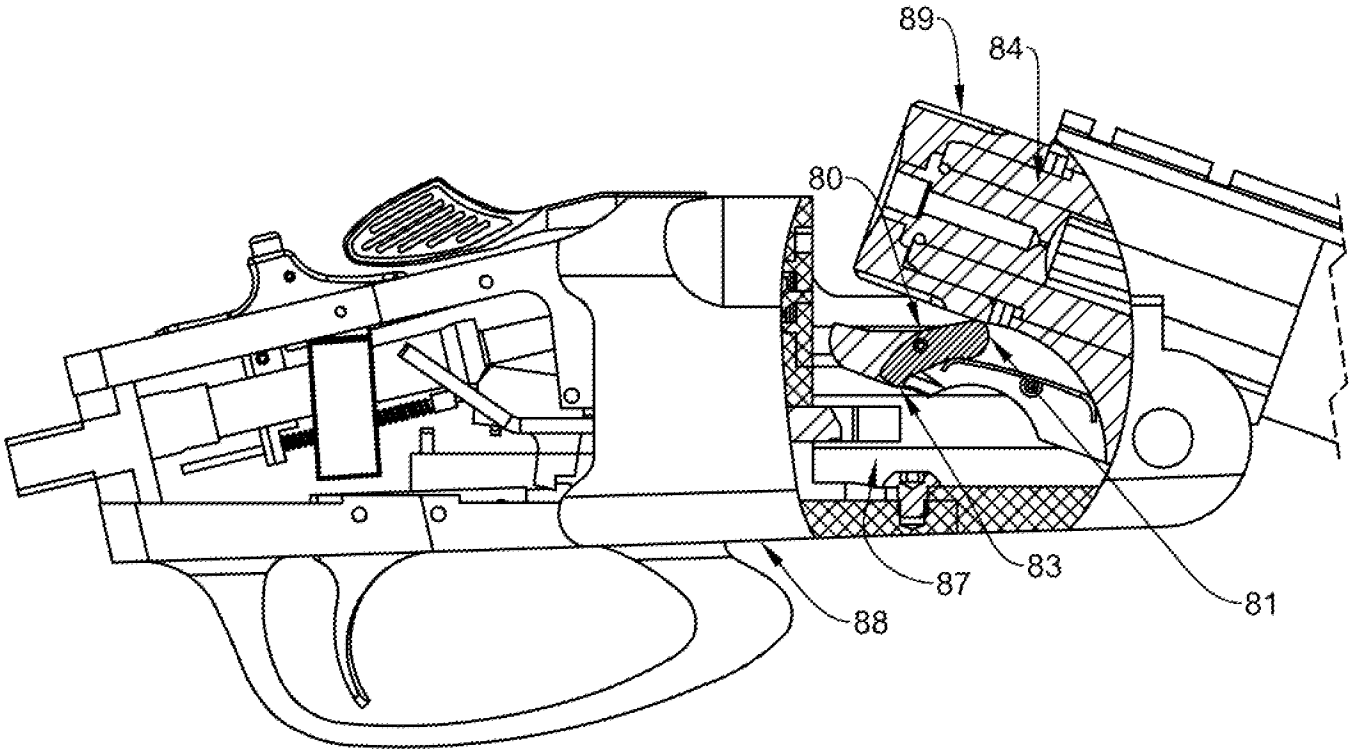
FIG. 8 is a side view of the open breech of a muzzle-loading firearm according to one embodiment of the present invention.
Figure 9:
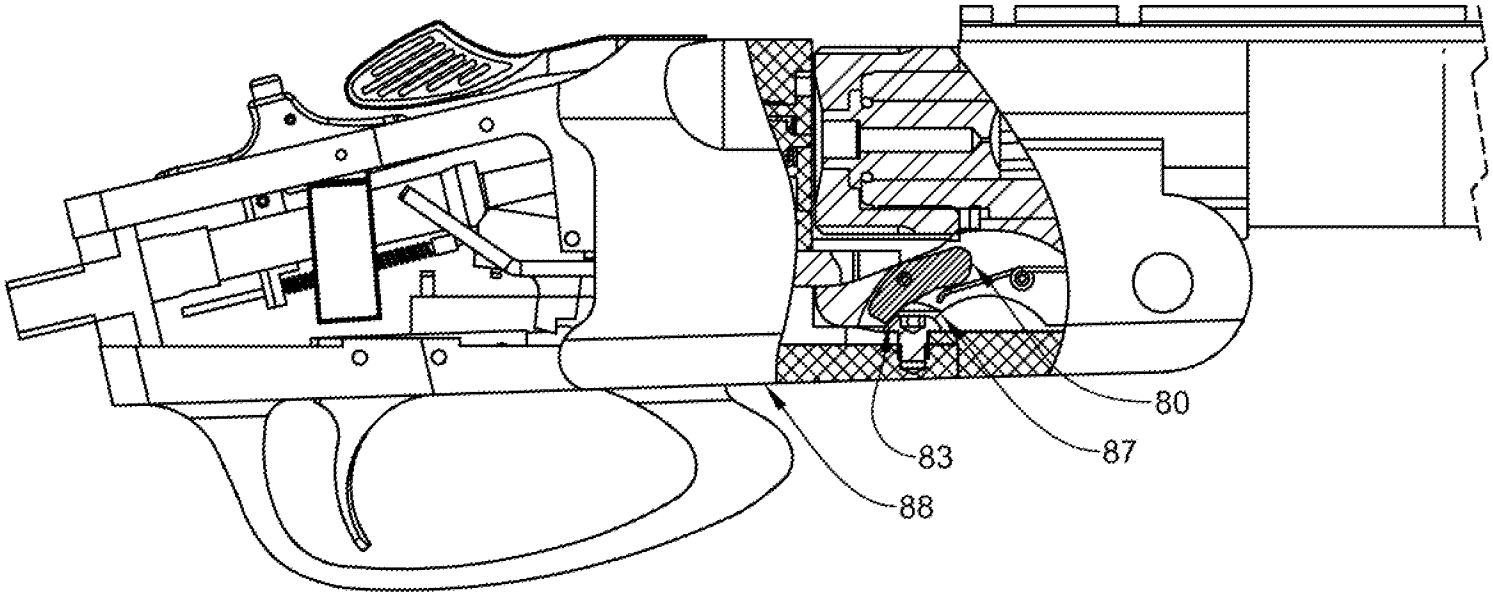
FIG. 9 is a side view of the closed breech of the muzzle-loading firearm shown in FIG. 8.

When the breech plug retaining collar 89 is fully threaded onto the barrel 84, as shown in FIG. 8, the breech plug retaining collar 89 impinges on the first end 81 of the interlock lever 80 and moves it into a second position. When the interlock lever 80 is in the second position, the breech can be closed, as shown in FIG. 9, because the protrusion 83 on the interlock lever 80 will not strike the button 87 on the receiver 88.

While the principles of the invention have been described herein, it is to be understood by those skilled in the art that this description is made only by way of example and not as a limitation as to the scope of the invention. Other embodiments are contemplated within the scope of the present invention in addition to the exemplary embodiments shown and described herein. Modifications and substitutions by one of ordinary skill in the art are considered to be within the scope of the present invention.

What is claimed:

1. A muzzle-loading firearm, comprising:

a barrel, wherein the barrel has a bore, a breech end, and a muzzle end, and wherein the barrel is externally-threaded at the breech end;

an internally-threaded breech plug retaining collar, wherein the internally-threaded breech plug retaining collar has a breech face and a muzzle face and is threaded onto the breech end of the barrel; and a removable, threadless breech plug, wherein the breech plug has a breech end, a primer pocket recessed in the breech end, and a muzzle end configured to fit inside the breech end of the barrel, the breech end a the breech plug is set into the breech face of the internally-threaded breech plug retaining collar, and the muzzle end of the breech plug extends past the muzzle face of the breech plug retaining collar thereby retaining the breech plug inside the bore of the barrel of the firearm.

2. The muzzle-loading firearm of claim 1, wherein the muzzle end of the removable, threadless breech plug is concave.

3. The muzzle-loading firearm of claim 2, wherein the muzzle end of the removable, threadless breech plug is adapted to accommodate a pre-formed, pelletized propellant.

4. The. muzzle-loading firearm of claim 2, wherein the muzzle end of the removable, threadless breech plug is adapted to accommodate powder propellant.

5. The muzzle-loading firearm of claim 2, wherein the primer pocket of the removable, threadless breech plug is adapted to accept 209 primers.

* * * * *